US008622318B1

(12) United States Patent
Clark et al.

(10) Patent No.: US 8,622,318 B1
(45) Date of Patent: Jan. 7, 2014

(54) INTEGRAL ELASTOMERIC COVERED BODY CAP FOR IRRIGATION SPRINKLER

(75) Inventors: Michael L. Clark, San Marcos, CA (US); Daniel E. Hunter, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 719 days.

(21) Appl. No.: 12/206,197

(22) Filed: Sep. 8, 2008

Related U.S. Application Data

(63) Continuation-in-part of application No. 11/392,072, filed on Mar. 29, 2006, now abandoned.

(51) Int. Cl.
*B05B 3/04* (2006.01)

(52) U.S. Cl.
USPC ..... 239/240; 239/114; 239/123; 239/237; 239/288; 239/288.5; 239/602; 239/DIG. 19

(58) Field of Classification Search
USPC ..... 239/200–210, 380–389, 104, 106, 114, 239/115, 123, 237, 240, 241, 288–288.5, 239/602, DIG. 19
See application file for complete search history.

(56) References Cited

U.S. PATENT DOCUMENTS

| | | | | | |
|---|---|---|---|---|---|
| 1,717,709 | A | | 6/1928 | Johnson | 239/288.5 |
| 1,770,764 | A | * | 7/1930 | Brooks | 239/204 |
| 3,921,910 | A | * | 11/1975 | Hayes et al. | 239/205 |
| 4,078,726 | A | * | 3/1978 | Walto | 239/205 |
| 4,316,579 | A | | 2/1982 | Ray et al. | 239/123 |
| 4,625,914 | A | | 12/1986 | Sexton et al. | 239/206 |
| 4,681,259 | A | * | 7/1987 | Troup et al. | 239/288.5 |
| 4,682,732 | A | * | 7/1987 | Walto | 239/123 |
| 4,718,605 | A | | 1/1988 | Hunter | 239/242 |
| 4,787,558 | A | | 11/1988 | Sexton et al. | 239/205 |
| 4,790,481 | A | * | 12/1988 | Ray et al. | 239/204 |
| 4,796,809 | A | | 1/1989 | Hunter | 239/205 |
| 4,892,252 | A | | 1/1990 | Bruninga | 239/205 |
| 4,986,474 | A | | 1/1991 | Schisler et al. | 239/205 |
| 5,004,157 | A | | 4/1991 | Martell | 239/205 |
| 5,005,767 | A | | 4/1991 | Heren | 239/288 |
| 5,222,669 | A | | 6/1993 | Lawson | 239/205 |
| 5,383,600 | A | | 1/1995 | Verbera et al. | 239/205 |
| 5,423,486 | A | | 6/1995 | Hunter | 239/205 |
| 5,620,141 | A | | 4/1997 | Chiang | 239/206 |
| 5,762,270 | A | | 6/1998 | Kearby et al. | 239/205 |
| 5,765,757 | A | | 6/1998 | Bendall | 239/205 |
| 5,772,118 | A | | 6/1998 | Fabiano | 239/276 |
| 5,988,523 | A | | 11/1999 | Scott | 239/114 |
| 5,992,760 | A | * | 11/1999 | Kearby et al. | 239/205 |
| 6,042,021 | A | | 3/2000 | Clark | 239/205 |
| 6,050,502 | A | | 4/2000 | Clark | 239/237 |
| 6,082,632 | A | | 7/2000 | Clark et al. | 239/205 |
| 6,138,924 | A | | 10/2000 | Hunter et al. | 239/204 |
| 6,182,909 | B1 | | 2/2001 | Kah, Jr. et al. | 239/206 |

(Continued)

*Primary Examiner* — Steven J Ganey
(74) *Attorney, Agent, or Firm* — Knobbe, Martens, Olson & Bear LLP

(57) ABSTRACT

A sprinkler has a hollow outer case and a riser vertically reciprocable within the outer case through an upper end thereof. A nozzle is mounted at an upper end of the riser. A body cap fits over the upper end of the outer case and retains the riser. The body cap has a plurality of circumferentially spaced vertical ribs that connect a reduced diameter upper portion of the body cap with an enlarged lower portion of the body cap. An elastomeric cover extends over at least the reduced diameter upper portion of the body cap and at least a portion of the ribs.

22 Claims, 6 Drawing Sheets

(56) References Cited

U.S. PATENT DOCUMENTS

| | | | | |
|---|---|---|---|---|
| 6,299,075 | B1 * | 10/2001 | Koller | 239/106 |
| 6,439,476 | B1 | 8/2002 | Boggs | 239/203 |
| 6,543,704 | B2 | 4/2003 | Stephens | 239/201 |
| 6,695,223 | B2 * | 2/2004 | Beutler et al. | 239/201 |
| 6,732,950 | B2 | 5/2004 | Ingham, Jr. et al. | 239/205 |
| 6,817,543 | B2 | 11/2004 | Clark | 239/205 |
| 6,840,460 | B2 | 1/2005 | Clark | 239/205 |
| 6,848,632 | B2 * | 2/2005 | Clark | 239/240 |
| 6,869,026 | B2 | 3/2005 | McKenzie et al. | 239/237 |
| 6,945,471 | B2 | 9/2005 | McKenzie et al. | 239/237 |
| 6,957,782 | B2 | 10/2005 | Clark et al. | 239/200 |
| 7,040,553 | B2 | 5/2006 | Clark | 239/263.3 |
| 7,287,711 | B2 | 10/2007 | Crooks | 239/240 |
| 7,600,699 | B2 * | 10/2009 | Kah et al. | 239/203 |
| 2006/0261182 | A1 | 11/2006 | Kah, Jr. et al. | 239/203 |

* cited by examiner

INTEGRAL ELASTOMERIC COVERED BODY CAP FOR IRRIGATION SPRINKLER

CROSS-REFERENCE TO RELATED APPLICATION

This application is a continuation-in-part of the similarly entitled U.S. patent application Ser. No. 11/392,072 filed Mar. 29, 2006 having the same co-inventors.

FIELD OF THE INVENTION

The present invention relates to sprinklers used to irrigate turf and landscaping.

BACKGROUND

A common type of irrigation sprinkler, referred to as a rotor-type sprinkler, has an outer cylindrical casing that is buried in the ground and a central telescoping riser that pop ups to irrigate the adjacent turf or landscaping. The riser typically encloses a turbine, reduction gear train and reversing mechanism which oscillate a cylindrical turret or head that is rotatably mounted at the upper end of the riser and contains a nozzle. The upper circular surface of the turret often has an elastomeric disk attached to the upper surface thereof which provides some degree of cushioning if a person should fall onto the sprinkler, particularly when the sprinkler is located in a playing field. The elastomeric disk usually has one or more cross-hair slits that allow a tool, such as the HUNTER® tool, to be inserted for adjusting the arc of coverage of the sprinkler and for lifting the riser when the water is OFF. This arrangement provides a degree of contamination protection because when the tool is withdrawn from the cross-hair slits they return to their planar condition and restrict soil, insects and other debris from entering into the passage leading to the arc adjustment mechanism. In addition to an elastomeric cover, some commercial rotor-type sprinklers have included an elastomeric cylindrical sleeve that covers a reduced diameter upper portion of the body cap that screws over the outer cylindrical case and holds the riser within the outer case. This elastomeric sleeve is held in place by a hard plastic retainer ring which is typically fixed in position by sonic welding.

Pop-up rotor-type sprinklers are typically installed in the ground so that the top surface of the sprinkler is close to the top surface of the ground. This ensures that they will not be clipped by mower blades and also reduces the likelihood that people will trip over the sprinklers. It is frequently necessary to service a conventional rotor-type sprinkler by unscrewing the body cap so that the riser and other components can be removed, repaired and replaced. The ribs on the body cap are typically below the top surface of the ground and are covered with wet soil. However, the hard plastic retainer ring significantly impedes the ability to grip the body cap and unscrew the same. Since the ribs are typically uncovered hard plastic, they are slick and difficult to grip.

SUMMARY OF THE INVENTION

It would be desirable to provide a rotor-type sprinkler with improved cushioning on the body cap to further reduce the risk of injury, provide enhanced serviceability of this type of sprinkler, and provide for its improved manufacturability.

In accordance with an embodiment of the invention a sprinkler has a hollow outer case and a riser vertically reciprocable within the outer case through an upper end thereof. A nozzle is mounted at an upper end of the riser. A body cap fits over the upper end of the outer case and retains the riser. The body cap has a plurality of circumferentially spaced vertical ribs that connect a reduced diameter upper portion of the body cap with an enlarged lower portion of the body cap. An elastomeric cover extends over at least the reduced diameter upper portion of the body cap and at least a portion of the ribs.

DETAILED DESCRIPTION

The entire disclosures of U.S. Pat. No. 6,050,502 granted to Clark on Apr. 18, 2000 and U.S. Pat. No. 6,840,460 granted to Clark on Jan. 11, 2005 are hereby incorporated by reference.

Figure 1:
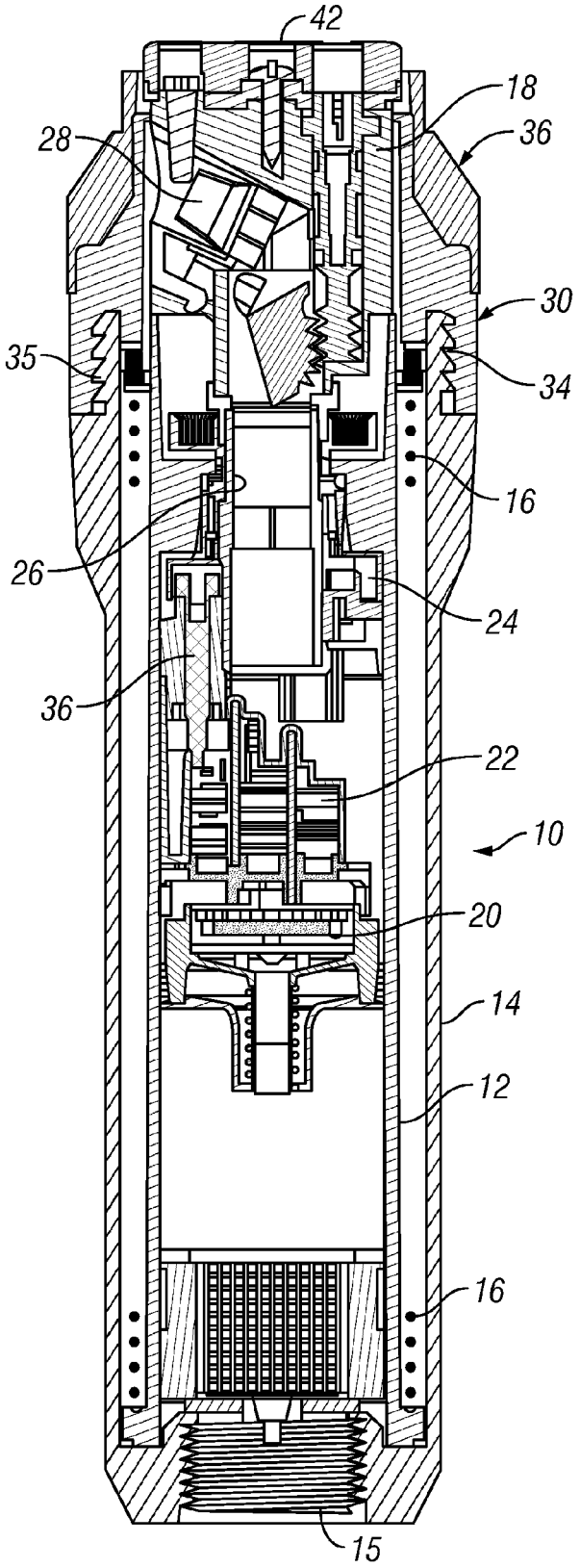
FIG. 1 is a vertical sectional view of a rotor-type sprinkler in accordance with an embodiment of the present invention that includes an elastomeric covered body cap.
Figure 2:
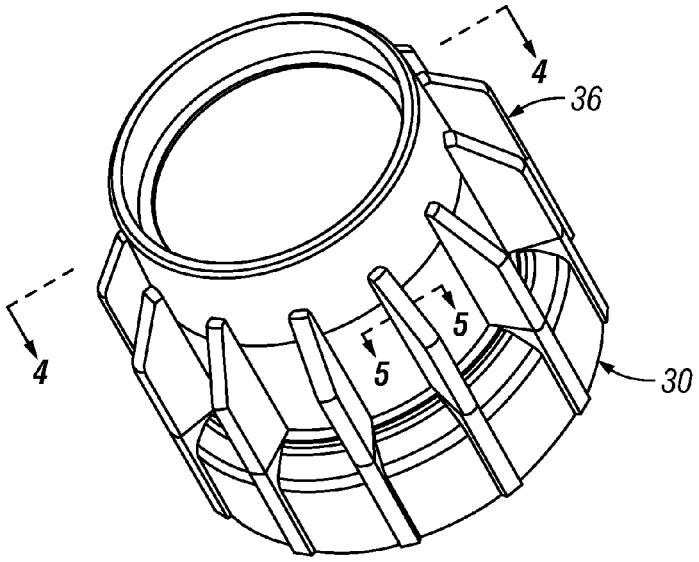
FIG. 2 is an enlarged isometric view of the elastomeric covered body cap of the sprinkler of FIG. 1.

Referring to FIG. 1, in accordance with an embodiment of the invention, a rotor-type sprinkler 10 includes a tubular riser 12 vertically reciprocable within an outer case 14 having a female threaded lower inlet 15. The riser 12 is normally held in a retracted position inside the outer case 14 by a coil spring illustrated diagrammatically by dots 16. An elastomeric wiper seal (unnumbered in FIG. 1) is positioned between the riser 12 and the outer case 14. A cylindrical nozzle head or turret 18 is rotatably mounted at the upper end of the riser 12. A turbine 20, reduction gear train 22, and a reversing mechanism 24 are mounted in the riser 12 and rotate the nozzle turret 18 through an adjustable arc, as well known in the art. Besides the turbine 20, other impellers may be used, such as ball drives, swirl plates, and so forth.

Together the reduction gear train 22 and reversing mechanism 24 form a drive assembly coupling the turbine 20 and the nozzle turret 18 via a relatively large hollow tubular shaft 26. Water flows through the turbine 20, through the shaft 26 and exits through a replaceable nozzle 28 mounted in the nozzle turret 18. A body cap 30 screws over the male threaded upper end of the outer case 14 and retains the riser 12.

Figure 3:
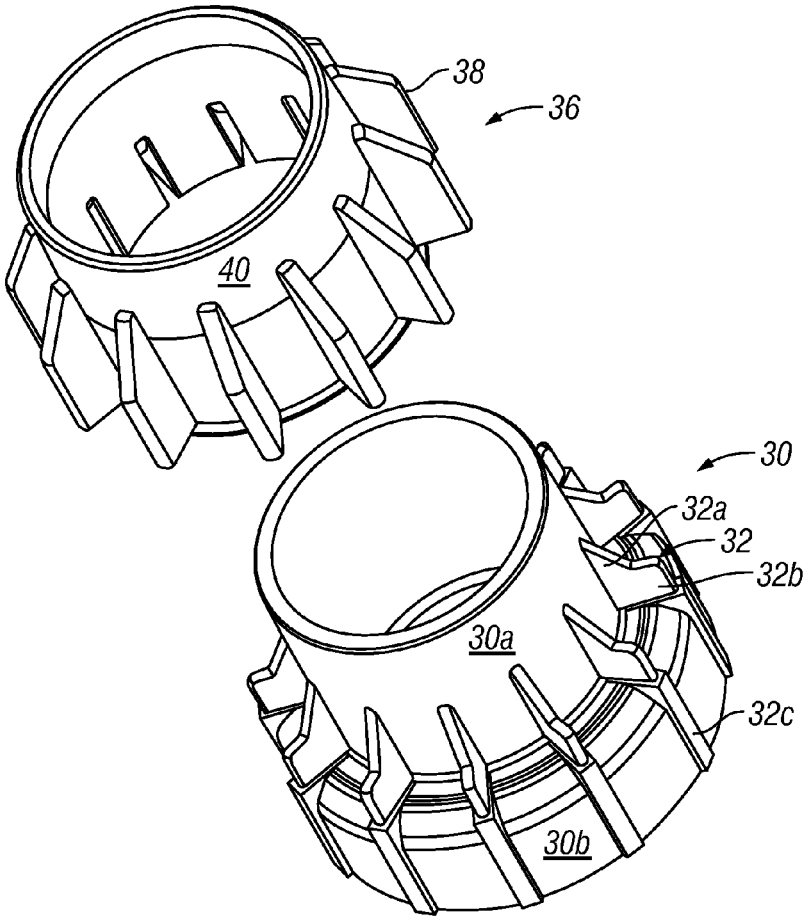
FIG. 3 is an exploded isometric view of the elastomeric covered body cap of FIG. 2.
Figure 4:
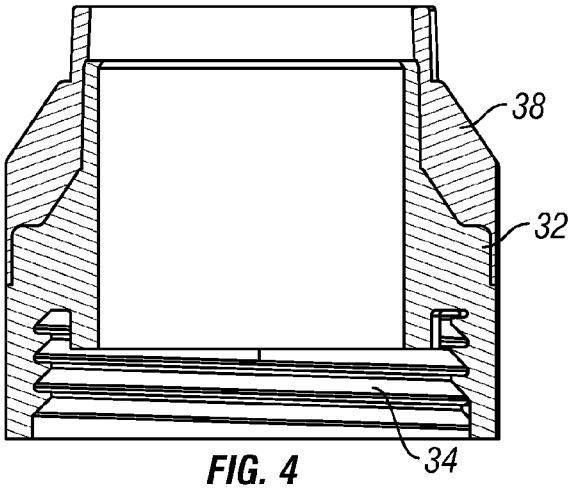
FIG. 4 is a vertical section of the elastomeric covered body cap taken along line 4-4 of FIG. 2.
Figure 11:
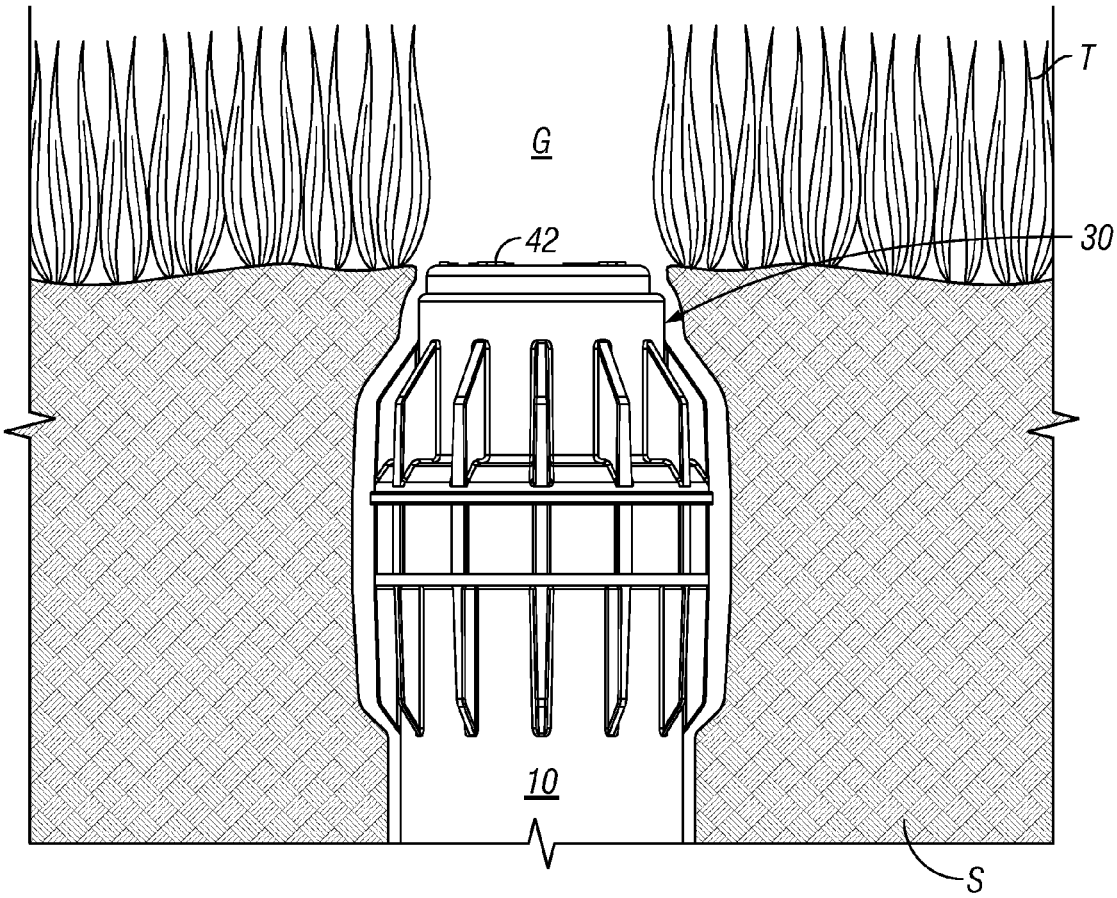
FIG. 11 is a fragmentary vertical sectional view of a section of soil and turf illustrating the installation of the sprinkler of FIG. 1.

Referring to FIGS. 3 and 4, the body cap 30 is injection molded of suitable relatively hard thermoplastic material such as acrylonitrile butadiene styrene (ABS) plastic. The body cap 30 is generally cylindrical and has a plurality of circumferentially spaced, radially and vertically extending, external ribs 32 that connect a reduced diameter upper portion 30*a* of the body cap 30 with an enlarged lower portion 30*b* of the body cap 30. Each of the ribs 32 has an upper generally triangular section 32*a* and a lower generally rectangular section 32*b*. The ribs 32 include extensions 32*c* that span an entire vertical height of the enlarged lower portion 30*b* of the body cap 30. The ribs 32 provide added structural integrity and strength to the body cap 30 and provide non-slip surfaces for facilitating manual gripping of the body cap 30 and unscrewing it from the outer case 14 when the sprinkler 10 is buried in the ground as illustrated in FIG. 11. The enlarged lower portion 30*b* of the body cap 30 has female threads 34 that screw over male threads 35 (FIG. 1) on the upper end of the outer case 14.

Figure 5:
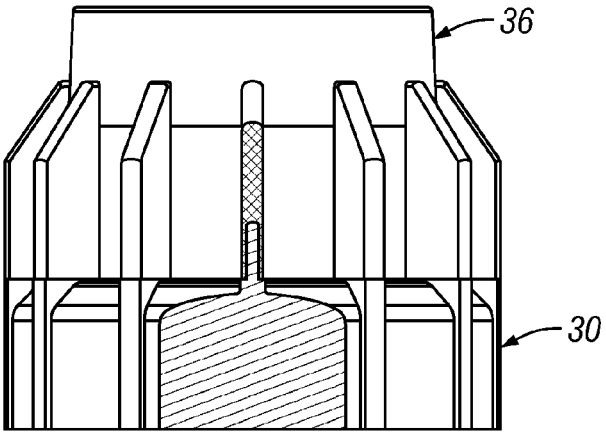
FIG. 5 is a vertical section of the elastomeric covered body cap taken along line 5-5 of FIG. 2.
Figure 6:
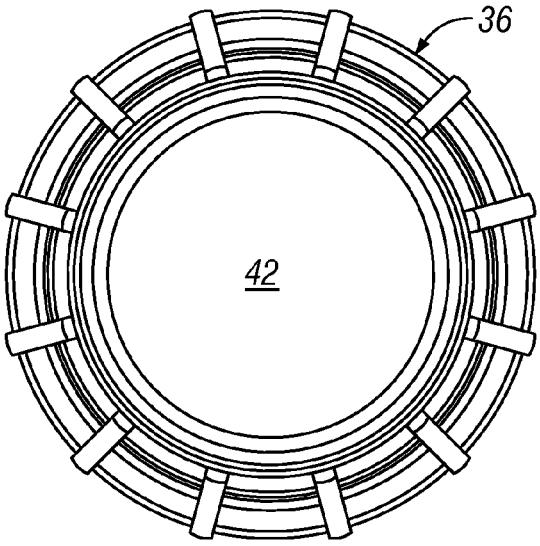
FIG. 6 is a top plan view of the elastomeric covered body cap of FIG. 2.
Figure 7:
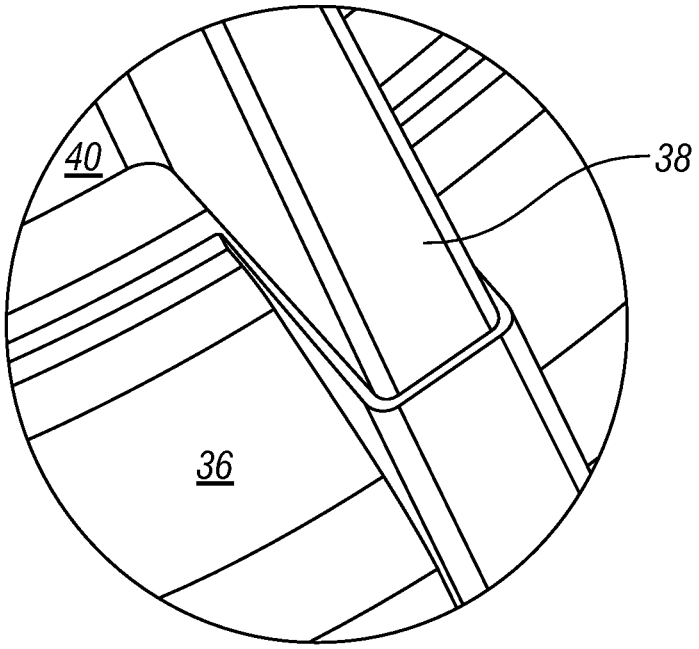
FIG. 7 is an enlarged fragmentary isometric view illustrating details of the ribs of the elastomeric covered body cap of FIG. 2.

In accordance with an embodiment of the present invention, a generally cylindrical elastomeric cover 36 (FIGS. 3 and 4) extends over the reduced diameter upper portion 30*a* of the body cap 30 and at least the portions 32*a* and 32*b* of the ribs 32. The elastomeric cover 36 may be co-molded over the body cap 30 to provide a mechanical interlock between the cover 36 and the body cap 30. Alternatively, the elastomeric cover 36 may be chemically bonded to the body cap 30. To this end the elastomeric cover 36 is preferably made of suitable relatively soft thermoplastic elastomer such as thermoplastic rubber that is sold under the trademark SANTOPRENE. The cover 36 may also be attached to the body cap 30 with a suitable adhesive or with clamps, detents, compression fittings and other suitable mechanical means. Permanent attachment of the outer elastomeric cover 36 to the inner body cap 30 in one of the aforementioned fashions is highly desirable so that these parts do not come apart when exposed for years to direct sunlight, moisture, and wide temperature fluctuations. As best seen in FIGS. 3, 4 and 5, the elastomeric cover 36 has a configuration that mirrors that of the body cap 30 and includes a plurality of similarly shaped external ribs 38 (FIG. 7) that extend from a central cylindrical portion 40. The ribs 38 coincide with ribs 32 and the cylindrical portion 40 overlies the upper portion 30*a* of the body cap 30. Preferably both the inner rigid body cap 30 and the outer elastomeric cover 36 are both black in color.

An elastomeric disk 42 (FIG. 1) is attached to and covers an upper circular surface of the nozzle turret 18. Referring to FIG. 11, the sprinkler 10 is typically mounted in the soil S with the elastomeric disk 42 roughly level with the surface of the soil. The elastomeric body cap 30 is immersed in wet soil S. The riser 12 pops up through a gap G in the surrounding turf T when the sprinkler 10 is pressurized with water. Should the sprinkler 10 require servicing, the user can push his or her fingers into the damp soil S and grip the non-slip surfaces of the elastomeric ribs 38. This provides a more positive grip than the body cap of conventional rotor-type sprinklers and allows a person to more readily unscrew the body cap 30 from the outer case 14.

As illustrated in FIG. 11, the entire upper portion of the sprinkler 10 that is exposed is completely covered with soft elastomeric material. Should a person strike the upper portion of the sprinkler 10 with his or her foot, or fall on the same, the elastomeric cover 36 shields the person from the otherwise exposed part of the hard plastic body cap 30 and provides a degree of cushioning, The elastomeric disk 42 provides an additional degree of cushioning if a person should fall onto the sprinkler 10.

As mentioned above, some conventional rotor-type sprinklers have included an elastomeric cylindrical sleeve that covers a reduced diameter upper portion of the body cap. This elastomeric sleeve is held in place by a hard plastic retainer ring which is typically fixed in position by sonic welding. This slick plastic retainer ring makes it difficult to reliably grip the body cap and unscrew it from the outer case. The plastic retainer ring also creates pockets that trap wet soil and make removal of the body cap even more difficult. Manufacturing this three piece prior art body cap is much more difficult than manufacturing the body cap of the present invention. This is because plastic parts do not cure perfectly round and they must be fitted to the plastic ring. These difficulties are overcome with the elastomeric covered body cap of the present invention which eliminates the hard plastic retainer ring.

The elastomeric disk 42 (FIG. 1) has one or more cross-hair slits (not illustrated) that allow a tool, such as the HUNTER® tool, to be inserted for adjusting the arc of coverage of the sprinkler 10 and for lifting the riser 12 when the water is OFF. As already mentioned, this arrangement of slits provides a degree of contamination protection when the tool is withdrawn from the cross-hair slits because they return to their planar condition and block soil, insects and other debris from entering into the passage leading to the arc adjustment mechanism.

Figure 8:
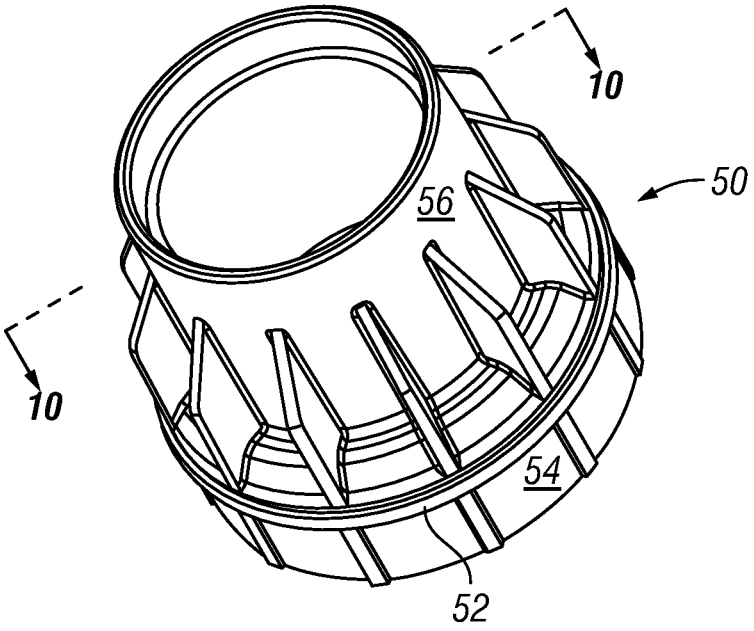
FIG. 8 is an enlarged isometric view of another embodiment of an elastomeric covered body cap for a sprinkler.
Figure 9:
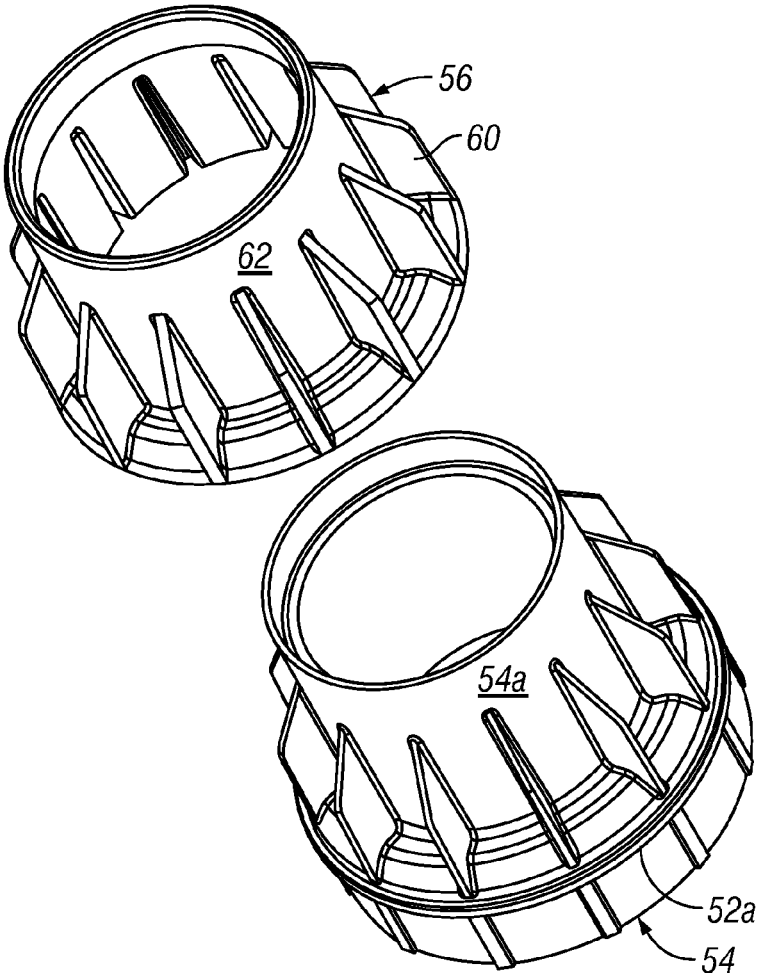
FIG. 9 is an exploded isometric view of the elastomeric covered body cap of FIG. 8.
Figure 10:
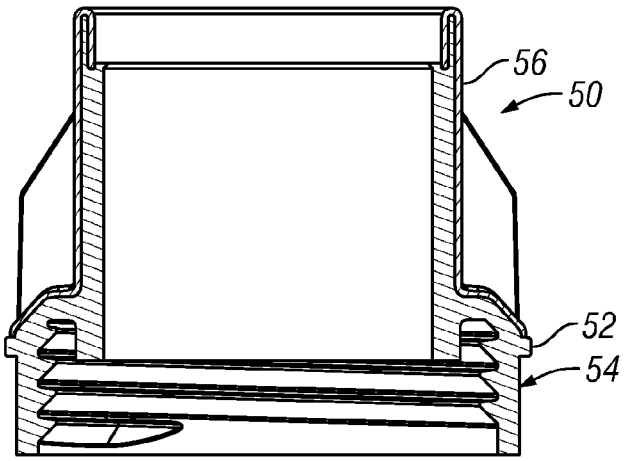
FIG. 10 is a vertical section of the elastomeric covered body cap of FIG. 8 taken along line 10-10 of FIG. 8.

FIG. 8 is an enlarged isometric view of another embodiment of an elastomeric covered body cap 50 for the rotor-type sprinkler 10. The elastomeric body cap 50 is similar to the cap 30 illustrated in FIGS. 2-7, except that the former includes a small land or wall section 52 formed in the injection molded inner hard plastic body cap 54. The land 52 is a radial cylindrical projection that is pinched during the co-molding process so that the elastomeric cover 56 does not flash or protrude beyond a predetermined height. It is desirable to limit the extension of the elastomeric cover 56 in order to give the finished elastomeric body cap 50 a cleaner look. FIG. 9 is an exploded isometric view of the elastomeric covered body cap 50 of FIG. 8. FIG. 10 is a vertical section of the elastomeric covered body cap 50 taken along line 10-10 of FIG. 8. The elastomeric cover 56 has a configuration that mirrors that of the hard plastic body cap 54 and includes a plurality of similarly shaped external ribs 60 (FIG. 9) that extend from a central cylindrical portion 62. The ribs 60 envelope the ribs 64 on the hard plastic body cap 54 and the cylindrical portion 62 overlies the upper portion 54*a* of the body cap 54.

While we have described an embodiment of our invention, those skilled in the art will understand that our invention may be modified in both arrangement and detail. For example, the hard plastic body cap 30 and elastomeric cover 36 need not have ribs. As another example, the elastomeric cover 36 can completely cover the entire height of the exterior of enlarged lower portion 30*b* of the body cap 30. It is preferable that the female threads 34 (FIG. 4) not be covered with elastomeric material to facilitate secured threaded engagement between the body cap 30 and the male threads 35 (FIG. 1) on the upper end of the outer case 14. The invention may be adapted to sprinklers other than rotor-type sprinklers, such as fixed spray type, rotary stream, and other types of pop-up sprinklers. Therefore, the protection afforded our invention should only be limited in accordance with the scope of the following claims.

We claim:

1. A sprinkler, comprising:

a hollow outer case;

a riser vertically reciprocable within the outer case through an upper end thereof;

a nozzle in a turret rotatably mounted at an upper end of the riser to determine an area watered by the nozzle;

an impeller and a reduction gear train mounted in the riser and coupled to the nozzle turret for rotating the nozzle;

a body cap that fits over the upper end of the outer case and retains the riser and has a plurality of circumferentially spaced vertical ribs that connect a reduced diameter generally cylindrical upper portion of the body cap with an enlarged diameter generally cylindrical lower portion of the body cap, the body cap being injection molded out of a hard thermoplastic material, and having a first set of threads formed on the enlarged lower portion of the body cap that screw over a second set of threads formed on a surface of the upper end of the outer case; and an elastomeric cover formed over at least the reduced diameter upper portion of the body cap and at least a portion of the ribs to provide a mechanical interlock between the cover and the body cap;

wherein the elastomeric cover has a plurality of external ribs formed that each envelope a corresponding rib of the body cap.

2. The sprinkler of claim 1 wherein the elastomeric cover is made of a soft thermoplastic elastomer.

3. The sprinkler of claim 1 wherein each rib has an upper generally triangular section and a lower generally rectangular section.

4. The sprinkler of claim 1 wherein an elastomeric disk covers an upper circular surface of the turret.

5. The sprinkler of claim 1 and further comprising a reversing mechanism mounted in the riser and coupled to the nozzle turret for rotating the nozzle back and forth through a pre-selected arc.

6. The sprinkler of claim 1 and further comprising a spring surrounding the riser within the outer case that biases the riser to a retracted position and an elastomeric wiper seal between the riser and the outer case.

7. The sprinkler of claim 1 wherein the ribs include extensions that span an entire vertical height of the enlarged lower portion of the body cap.

8. The sprinkler of claim 1 wherein the body cap is formed with a land in the form of radially extending projection that is located at a lower boundary of the elastomeric cover.

9. The sprinkler of claim 1 wherein the elastomeric cover is co-molded over the reduced diameter upper portion of the body cap.

10. The sprinkler of claim 1 wherein the elastomeric cover is bonded to the reduced diameter upper portion of the body cap.

11. A sprinkler comprising:

a hollow outer case having an upper end;

a riser vertically reciprocable within the outer case through the upper end thereof;

a nozzle mounted adjacent an upper end of the riser;

a rigid body cap positioned adjacent the upper end of the outer case and comprising:

a lower cap portion having an outer diameter;

an upper cap portion having an outer diameter that is less than the outer diameter of the lower cap portion; and a plurality of ribs extending from the lower cap portion to the upper cap portion, each rib having a lower rib portion and an upper rib portion wherein the upper rib portion has a thickness that is less than a thickness of the lower rib portion; and an elastomeric cover formed over the upper cap portion and enveloping the upper rib portion of each rib.

12. The sprinkler of claim 11 further comprising female threads formed on an interior of the lower cap portion.

13. The sprinkler of claim 11 wherein each rib has an upper generally triangular section and a lower generally rectangular section.

14. The sprinkler of claim 11, wherein the elastomeric cover has a plurality of external ribs.

15. The sprinkler of claim 11, wherein the elastomeric cover is co-molded over the upper cap portion.

16. A sprinkler, comprising:

a hollow outer case;

a riser vertically reciprocable within the outer case through an upper end thereof;

a nozzle in a turret rotatably mounted at an upper end of the riser to determine an area watered by the nozzle;

an impeller and a reduction gear train mounted in the riser and coupled to the nozzle turret for rotating the nozzle;

a body cap that fits over the upper end of the outer case and retains the riser and has a plurality of circumferentially spaced vertical ribs that connect a reduced diameter generally cylindrical upper portion of the body cap with an enlarged diameter generally cylindrical lower portion of the body cap, the body cap being injection molded out of a hard thermoplastic material, and having a first set of threads formed on the enlarged lower portion of the body cap that screw over a second set of threads formed on a surface of the upper end of the outer case; and an elastomeric cover formed over at least the reduced diameter upper portion of the body cap and at least a portion of the ribs to provide a mechanical interlock between the cover and the body cap;

wherein the body cap is formed with a land in the form of radially extending projection that is located at a lower boundary of the elastomeric cover.

17. The sprinkler of claim 16 wherein the elastomeric cover is made of a soft thermoplastic elastomer.

18. The sprinkler of claim 16 wherein each rib has an upper generally triangular section and a lower generally rectangular section.

19. The sprinkler of claim 16 wherein an elastomeric disk covers an upper circular surface of the turret.

20. The sprinkler of claim 16 and further comprising a reversing mechanism mounted in the riser and coupled to the nozzle turret for rotating the nozzle back and forth through a pre-selected arc.

21. The sprinkler of claim 16 wherein the ribs include extensions that span an entire vertical height of the enlarged lower portion of the body cap.

22. The sprinkler of claim 16 wherein the elastomeric cover has a plurality of external ribs formed that each envelope a corresponding rib of the body cap.

* * * * *